United States Patent [19]

Shimizu et al.

[11] Patent Number: 4,981,442

[45] Date of Patent: Jan. 1, 1991

[54] ELECTRICAL HARNESS

[75] Inventors: Kaneyoshi Shimizu, Minohshi; Koji Sumiya, Kasuga, both of Japan

[73] Assignee: Nippon Acchakutanshi Seizo Kabushiki Kaisha, Osaka, Japan

[21] Appl. No.: 327,038

[22] Filed: Mar. 22, 1989

[51] Int. Cl.[5] ..... H01R 4/24

[52] U.S. Cl. ..... 439/394; 439/578

[58] Field of Search ..... 439/394, 578–585

[56] References Cited

U.S. PATENT DOCUMENTS

| | | | |
|---|---|---|---|
| 3,510,827 | 5/1970 | Spangler | 439/394 |
| 4,261,632 | 4/1981 | Narozny | 439/394 |
| 4,701,001 | 10/1987 | Verhoeven | 439/394 |

*Primary Examiner*—Joseph H. McGlynn

*Attorney, Agent, or Firm*—Antonelli, Terry, Stout & Kraus

[57] ABSTRACT

An electrical harness includes a shield cable connected to contact-type connectors at each end, with the shield cable including insulation clad signal transmission wires and a carbon clad ground wire covered with a metal wire. The signal transmission wires and the carbon clad ground wire are alternately arranged at intervals and wrapped in an electrically conducting sheet covered with an outer insulation layer. Each connector includes contacts and retainers, with each contact having a slot adapted to tightly receive one of the signal transmission wires or the ground wire such that in the signal transmission wires the retainers engage the outer insulation layer and in the ground wire the retainers engage the metal wire, so as to effect electrical connection therebetween.

3 Claims, 2 Drawing Sheets

ELECTRICAL HARNESS

BACKGROUND OF THE INVENTION

The present invention relates to an electrical harness including a shield cable and contact-type connectors, and, more particularly, to an electrical harness adapted for use as a shielding wire in transmitting high-frequency signals.

It is known in the art to employ a shield cable connected to contact-type connectors, wherein the shield cable includes insulation clad signal transmission wires and carbon clad ground wires arranged mutually in parallel at equal intervals. The shield cable is completely wrapped in an electrically conducting foil, which is covered with an outermost insulating layer.

However, one disadvantage of the known shield cable is that the resulting shield effect is reduced, particularly in the high-frequency zones, because of the relatively high electrical resistance between the ground wires and the foil, which arises from the fact that the intermediate carbon layer has a higher electrical resistivity than the metal foil.

The present invention is to provide an electrical harness including a shield cable which solves the problems encountered by the known shield cable discussed above. Thus, an object of the present invention is to provide an electrical harness including a shield cable which can exhibit an enhanced shield effect even in the high-frequency zones.

SUMMARY OF THE INVENTION

According to the present invention, an electrical harness is provided which comprises a pair of connectors and a shield cable connected to the connectors at each end, with the shield cable comprising a plurality of insulation clad signal transmission wires and a carbon clad ground wire covered with a metal wire, which is preferably covered with an aluminum or a copper foil. The signal transmission wires and the ground wire are arranged at intervals and wrapped in an electrically conducting sheet covered with an outer insulation layer, with each connector comprising a housing each having contacts and retainers. Each contact has a slot adapted to tightly receive one of the signal transmission wires or the ground wire such that in the signal transmission wires the retainers engage the outer insulation layer and that in the ground wire the retainers engage the metal wire. so as to effect electrical connection therebetween.

Other objects and advantages of the present invention will become more apparent from the following detailed description, when taken in conjunction with the accompanying drawings which show, for the purpose of illustration only, one embodiment in accordance with the present invention.

DETAILED DESCRIPTION OF THE INVENTION

In this specification the term "electrical harness" means an assembly of connectors 2 and a shield cable 1 connected to the connectors 2 at each end.

Figure 1:
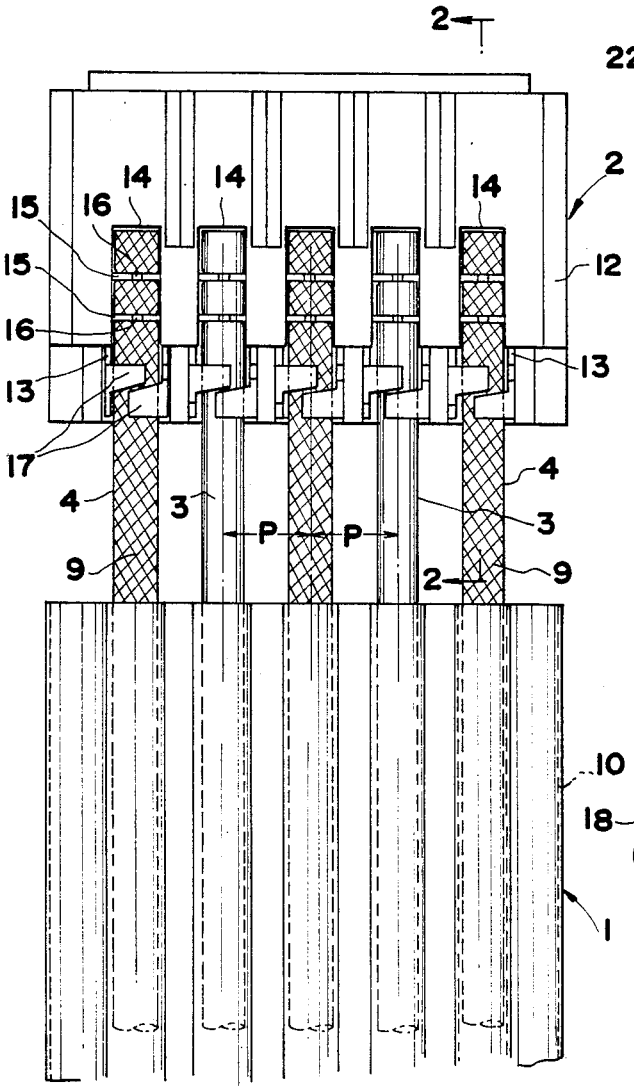
FIG. 1 is a front view showing a main part of the electrical harness according to the present invention.
Figure 2:
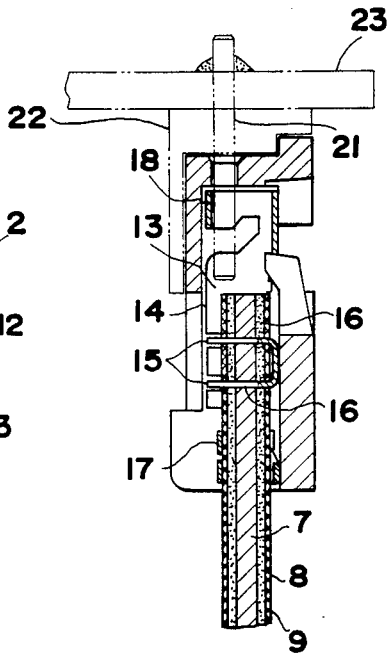
FIG. 2 is a cross-sectional view taken along the line 2—2 in FIG. 1.
Figure 5:
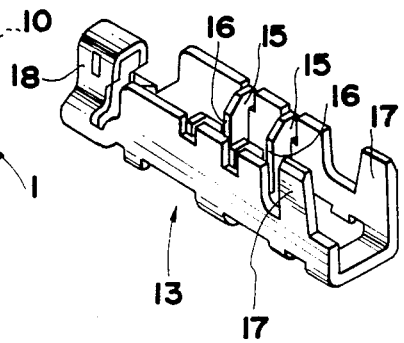
FIG. 5 is a perspective view showing one of the contacts.
Figure 3:
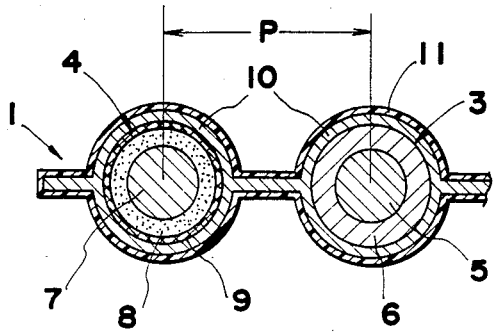
FIG. 3 is a cross section showing a part of the shield cable on an enlarged scale.
Figure 4:
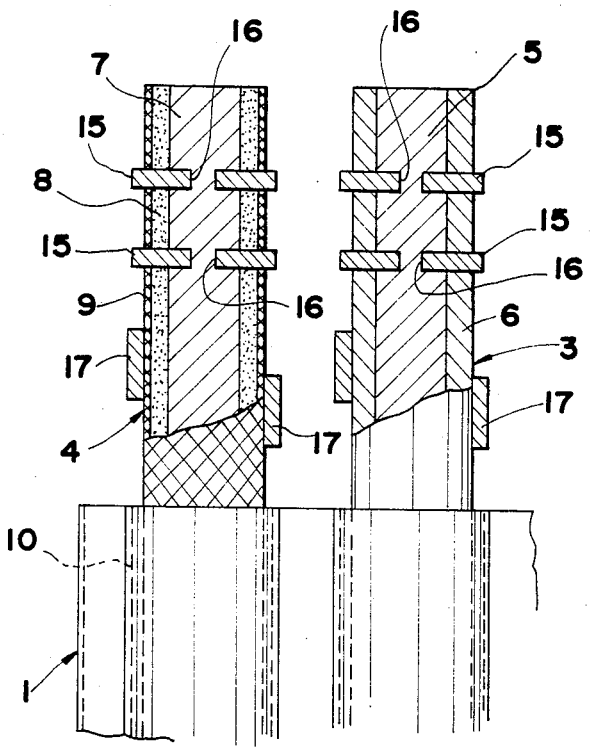
FIG. 4 is a partly sectional view showing the assembly of the shield cable and the connector.

As best shown in FIG. 3, the shield cable 1 includes a plurality of signal transmission wires 3, (hereinafter referred to merely as "signal wires"), and at least one ground wires 4 (the illustrated embodiment uses a plurality of ground wires). Each signal wire 3 contains a conductor 5 covered with an insulation 6 of plastic such as vinyl chloride, polyethylene, cross-linked polyethylene, foam polyethylene, and each ground wire 4 contains a core ground 7 covered with a carbon fiber 8, which is covered with metal wires 9 in the form of a mesh or a winding. Preferably, the metal wire 9 is covered with an aluminum or a copper foil so as to prevent the metal wire 9 from being exposed to the outside. When a plurality of ground wires 4 are used, it is preferred as shown in FIG. 1 that the signal wires 3 and the ground wires 4 are alternately arranged at equal pitch (axis-to-axis distance) P (normally 2.5mm) and wholly wrapped in an electrically conducting sheet 10 such as copper or aluminum foil, which is covered with an outermost insulating layer 11.

Each connector 2 has a housing 12 made of an insulating material such as nylon, which houses contacts 13 press formed of electrically conducting material such as phosphor bronze. The housing 12 includes a number of seats 14 for accommodating the individual contacts 13, wherein the interval between one contact 13 and the next is equal to the pitch P.

Each contact 13 includes a U shaped slot 16 and a retainer 17 in the form of bendable arms or ears. The U-shaped slot 16 tightly receives one of the signal wires 3 or the ground wires 4. Each contact 13 also includes a sleeve 18 which receives a terminal post 21 of a printed board 23 through an insulating base 22.

The signal wires 3 and the ground wires 4 of the shield cable 1 are connected to the respective contacts 13, wherein the arms 17 are bent to retain the respective signal wires 3 or ground wires 4 such that, in the signal wires 3, the bent arms 17 engage the outermost insulating layer 11 and, in the ground wires 4, they engage the metal mesh 9. In this way the shield cable 1 and the connectors 2 are assembled into an electrical harness, with the core grounds 7 being in electrical contact with the electrically conducting foil 10 through the contacts 13 and the metal mesh 9, thereby effecting metal-to-metal electrical connection. Thus, the shield effect by the ground wires 4 is enhanced even in the high-frequency zones.

As mentioned above, it is not necessary to use a plurality of ground wires 4 but at least one ground wire 4 suffices, which is disposed in place amid the row of the signal wires 3.

What is claimed is:

1. An electrical harness comprising a pair of connectors and a shield cable connected at opposite respective ends to the respective connectors, the shield cable comprising a plurality of insulation clad signal transmission wires and at least one carbon clad ground wire covered with a metal wire, the signal transmission wires and the at least one ground wires are respectively arranged at transversely spaced intervals across a width of the connectors with the at least one ground wire being arranged between adjacent signal transmission wires, an electrically conducting sheet covered with an outer insulation layer wrapped around said plurality of insulation clad signal wires and the at least one ground wire, each connector comprising a housing, each housing having a plurality of contacts and a plurality of retainers arranged transversely of the width of the respective connectors, each contact having a slot adapted to tightly receive one of the signal transmission wires or the at least one ground wire such that the retainers engage the outer insulation layer of the respective signal transmission wires and engage the metal wire of the at least one ground wire so as to effect electrical connection therebetween thereby enhancing the shield effect of the at least one ground wire.

2. An electrical harness as defined in claim 1, wherein the metal wire of the earth wire is covered with a metal foil so as to confine the metal wire under the covering of the electrically conducting sheet.

3. An electrical harness which comprises a pair of connectors and a shield cable connected to the connectors at each end, the shield cable comprising a plurality of insulation clad signal transmission wires and a plurality of carbon clad ground wires covered with a metal wire and arranged alternately with the signal transmission wires, wherein the signal transmission wires and the ground wires are arranged at intervals and wrapped in an electrically conducting sheet covered with an outer insulation layer, each connector comprising a housing each having contacts and retainers, each contact having a slot adapted to tightly receive one of the signal transmission wires of the ground wires such that in the signal transmission wires the retainers engage the outer insulation layer and that in the ground wire the retainers engage the metal wire, so as to effect electrical connection therebetween.

* * * * *